US006326961B1

(12) United States Patent
Lin et al.

(10) Patent No.: US 6,326,961 B1
(45) Date of Patent: Dec. 4, 2001

(54) AUTOMATIC DETECTION METHOD FOR TUNING THE FREQUENCY AND PHASE OF DISPLAY AND APPARATUS USING THE METHOD

(75) Inventors: Shih-Yin Lin; Chao-Ching Hwang; Ming-Yen Lin, all of Hsinchu (TW)

(73) Assignee: CTX Opto-Electronics Corp., Hsinchu (TW)

( * ) Notice: Subject to any disclaimer, the term of this patent is extended or adjusted under 35 U.S.C. 154(b) by 0 days.

(21) Appl. No.: 09/164,424

(22) Filed: Sep. 30, 1998

(51) Int. Cl.[7] ..... G09G 5/00

(52) U.S. Cl. ..... 345/213; 345/212; 345/204; 345/698; 345/699; 345/673; 327/141; 327/144; 327/145

(58) Field of Search ..... 345/204, 212, 345/213, 698, 699, 673; 327/141, 144, 145, 149–151

(56) References Cited

U.S. PATENT DOCUMENTS

| | | | | |
|---|---|---|---|---|
| 4,991,023 | * | 2/1991 | Nicols | 358/242 |
| 5,448,193 | * | 9/1995 | Baumert et al. | 327/156 |
| 5,914,963 | * | 6/1999 | Basile | 371/1 |
| 6,005,557 | * | 12/1999 | Wong | 345/204 |
| 6,011,534 | * | 1/2000 | Tanaka et al. | 345/98 |
| 6,029,250 | * | 2/2000 | Keeth | 713/400 |
| 6,046,735 | * | 4/2000 | Bassetti et al | 345/204 |
| 6,160,542 | * | 12/2000 | Hwang | 345/213 |
| 6,177,922 | * | 1/2001 | Schiefer et al. | 345/132 |
| 6,181,300 | * | 1/2001 | Poon et al. | 345/1 |
| 6,201,535 | * | 3/2001 | Hwang | 345/213 |
| 6,219,023 | * | 4/2001 | Kim | 345/127 |

* cited by examiner

*Primary Examiner*—Almis R. Jankus
*Assistant Examiner*—Henry N. Tran
(74) *Attorney, Agent, or Firm*—Winston Hsu

(57) ABSTRACT

This invention relates to an automatic detection method and apparatus for tuning the frequency and phase of displaying clock of a display to match the frequency and phase of pixel clock of a PC's display interface card. Based on the synchronized displaying clock, the image shown by digital display will be stable and bright in color. The automatic detection apparatus of invention includes a clock generation unit, a sampling unit, a data processing unit, an accumulation unit, and a decision unit. The clock generation unit creates a plurality of sampling clocks and according to these sampling packet sequences, the sampling unit samples and holds the pixel signals of image frames based on the pixel clock of display interface card, and then stores these data in its registers. The data processing unit calculates and transmits the differences of sampled data based on every sampling clock to accumulation unit that accumulates these differences, and transmits the sums of these differences to decision unit that finds out the sampling clock with the smallest transmitted sum, and let the phase and frequency of sampling clock with the smallest summed value as those of displaying clock of the PC display.

19 Claims, 13 Drawing Sheets

```
   0123456789------
0  0XXXXXXX0XXXXXXX
1  XXXX0XXXXXXX0XXX
2  XX0XXXXXXX0XXXXX
3  XXXXXX0XXXXXXX0X
4  X0XXXXXXX0XXXXXX
5  XXXXX0XXXXXXX0XX
6  XXX0XXXXXXX0XXXX
7  XXXXXXX0XXXXXXX0
8  0XXXXXXX0XXXXXXX
9  XXXX0XXXXXXX0XXX
|  XX0XXXXXXX0XXXXX
|  XXXXXX0XXXXXXX0X
|  X0XXXXXXX0XXXXXX
|  XXXXX0XXXXXXX0XX
|  XXX0XXXXXXX0XXXX
|  XXXXXXX0XXXXXXX0
```

Fig. 13

AUTOMATIC DETECTION METHOD FOR TUNING THE FREQUENCY AND PHASE OF DISPLAY AND APPARATUS USING THE METHOD

BACKGROUND OF THE INVENTION

1. Field of the Invention

This invention relates to an automatic detection method of digital display for measuring the phase and frequency of a pixel clock and an automatic detection apparatus using the method.

2. Description of Related Art

Display is the most important peripheral of personal computer (PC) and shows image frames through display interface card of PC. Based on the pixel clock of PC's display interface card, the analog red, blue, and green light signal sequence of the image frames pixels are serially sent to an analog display for showing text or graphic information. In general, the displaying clock of analog display must be synchronized with the pixel clock of display interface card by using a phase-lock loop (PLL). The display interface card does not provide the pixel clock to the display, and the synchronization of both clocks is hence not easily achieved. The parameters of PLL for synchronization are usually tuned manually according to experience of user or assembly person, and this object is very laborious and difficult. Recently, an automatic detection apparatus for measuring the phase and frequency of analog display had been provided. The apparatus captures and transfers the image of display with a video camera to electric signals, and then transmits these signals to the adjusting unit thereof through a RS232 bus. The adjusting unit of apparatus tunes the displaying clock's phase and frequency of PC display according to the captured image. The drawback of automatic detection apparatus of prior art is that its tuning accuracy and range are lower.

Today, PC displays are digitized. An image frame of digital display consists of a great number of pixels. Based on a pixel clock, the display interface card of a PC serially sends the pixel signals of image frames to a digital display. Based on a displaying clock consisting of a series of sampling instants, the digital display samples the signal sequence of image frame's pixels from the display interface card at each sampling instant. Hence, the above-mentioned displaying clock is usually also called the sampling clock of digital display. If the frequency or phase of displaying clock and the pixel clock are not matched, a signal at a pixel may be displayed at another pixel of digital display. Hence, the image shown by digital display will be distorted, unstable or ambiguous. As shown in FIG. 1 and FIG. 2, the sampling clock 104 of digital display and the pixel clock 102 of PC's display interface card have the same phase and frequency. The frequency or phase of displaying clock 104 is faster than the pixel clock 101 of PC's display interface card, and the frequency or phase of displaying clock 104 is slower than the pixel clock 103 of PC's display interface card. It is obvious that the frequency or phase of both pixel clocks 101 and 102, and the sampling clock 104 are not exactly matched. Hence, the image shown by digital display will be unstable, distorted or ambiguous.

SUMMARY OF THE INVENTION

The objective of the invention is to provide an automatic detection method for the displaying clock of digital display to measure the phase and frequency of a pixel clock for synchronization, i.e., to make the frequencies and phases of displaying clock and the pixel clock matched. Based on the synchronized displaying clock, the image shown by digital display will be stable and bright in color.

The other objective of the present invention is to provide an automatic detection apparatus, using the automatic detection method of the invention, for tuning the phase and frequency of the displaying clock of digital display. The automatic detection apparatus of invention includes a clock generation unit, a sampling unit, a data processing unit, an accumulation unit, and a decision unit. The clock generation unit creates a plurality of sampling clocks. According to these sampling packet sequences, the sampling unit samples and holds the pixel signals of image frames based on the pixel clock of display interface card, and then stores these sampled data in its registers. The data processing unit calculates and transmits the differences of sampled data based on every sampling clock to the accumulation unit. The accumulation unit accumulates these differences based on every sampling clock, and transmits the sums of these differences based on every sampling clock to the decision unit. According to the transmitted sums based on these different sampling clocks, the decision unit finds out the sampling clock with the smallest transmitted sum, and let the phase and frequency of sampling clock with the smallest summed value as those of the displaying clock of PC display.

BRIEF DESCRIPTION OF THE DRAWINGS

Other objects, features, and advantages of the invention will become apparent from the following detailed description of preferred but non-limiting embodiments. The description is made with reference to the accompanying drawings in which:

FIG. 9-1 illustrates the difference of two sampled data based on the sampling packet sequence with phase lead shown in FIG. 7;

FIG. 9-2 illustrates the difference of two sampled data based on the sampling packet sequence without phase lag or lead shown in FIG. 7;

FIG. 13 shows an embodiment of random sampling clock of the present invention.

DETAILED DESCRIPTION OF THE INVENTION

Figure 3:
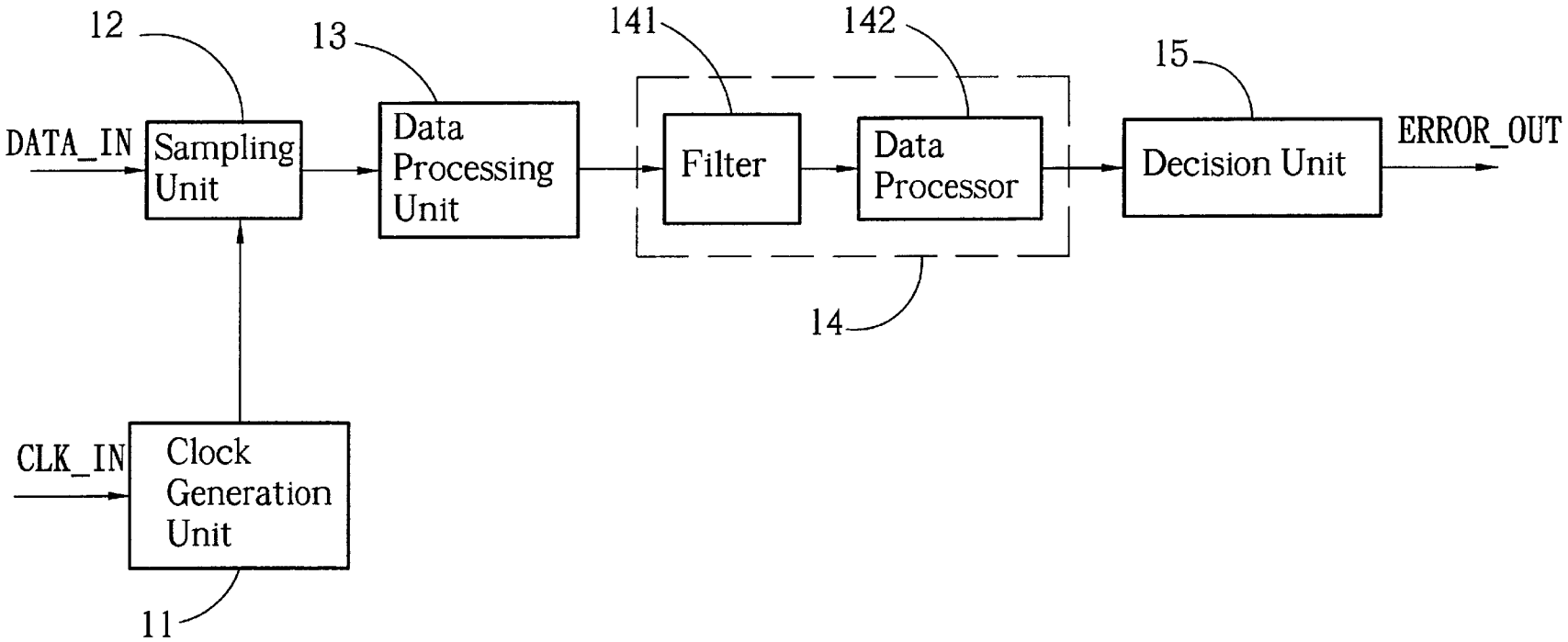
FIG. 3 is the block diagram of first embodiment of an automatic detection apparatus according to the present invention.
Figure 4:
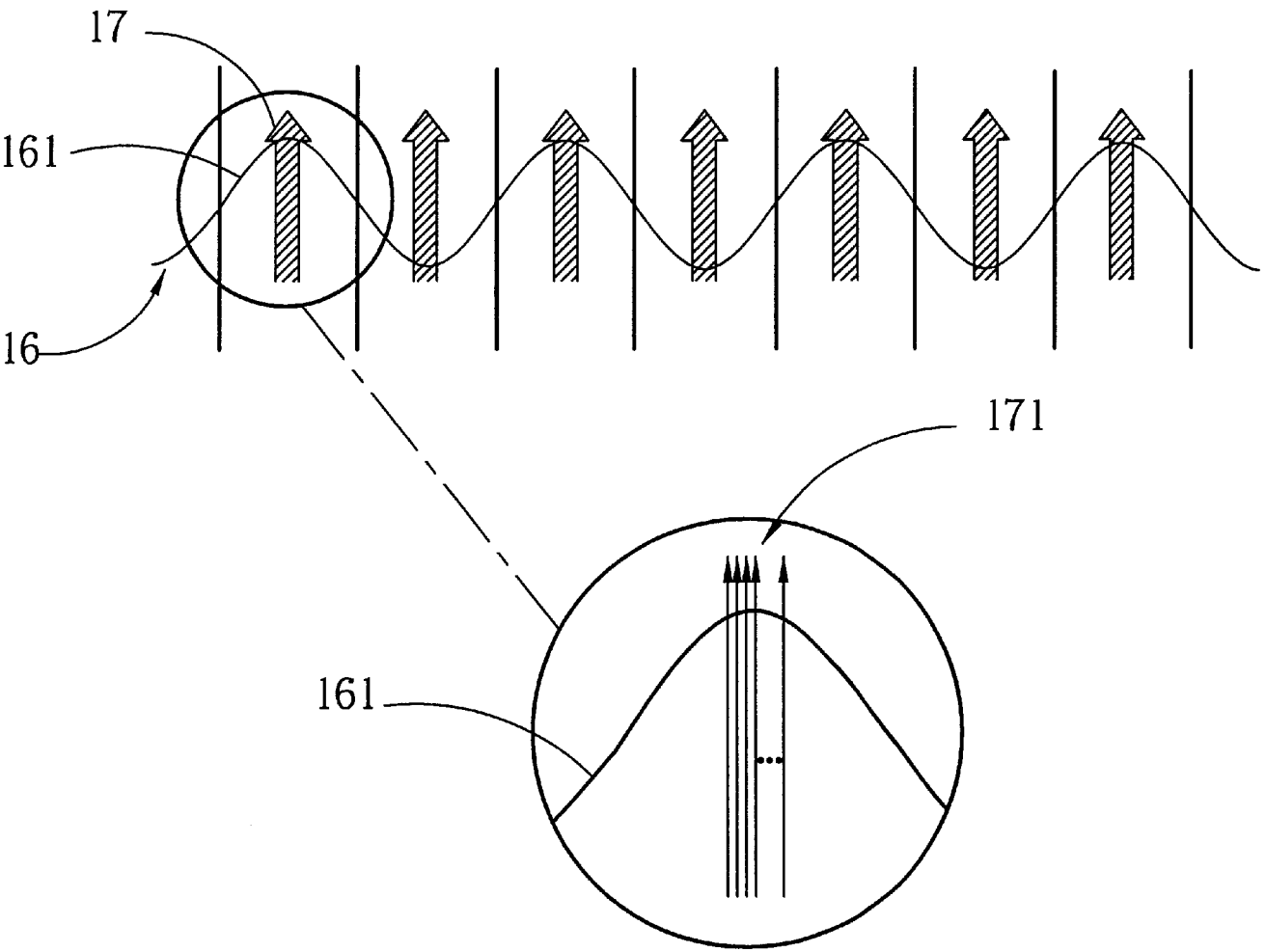
FIG. 4 is the schematic diagram of displaying clock of the present invention, which the displaying clock has multiple sampling instants at each sampling packet.

Please refer to FIG. 3, which shows the block diagram of first embodiment of an automatic detection apparatus according to the present invention. The automatic detection apparatus includes a clock generation unit 11, a sampling unit 12, a data processing unit 13, an accumulation unit 14, and a decision unit 15. The output of clock generation unit 11 is linked to an input of sampling unit 12. In addition, sampling unit 12, data processing unit 13, accumulation unit 14, and decision unit 15 are serially connected in order. The clock generation unit 11 creates a plurality of sampling packet sequences 17 as shown in FIG. 4. Every sampling packet consists of a plurality of sampling instants 171 and each sampling packet sequence forms a sampling clock. Based on sampling sequences 17, the sampling unit 12 samples a pixel signal sequence 16 consisting of a plurality of pixel signals 161, and the pixel signal sequence 16 is based on a pixel clock from a PC's display interface card.

Figure 5:
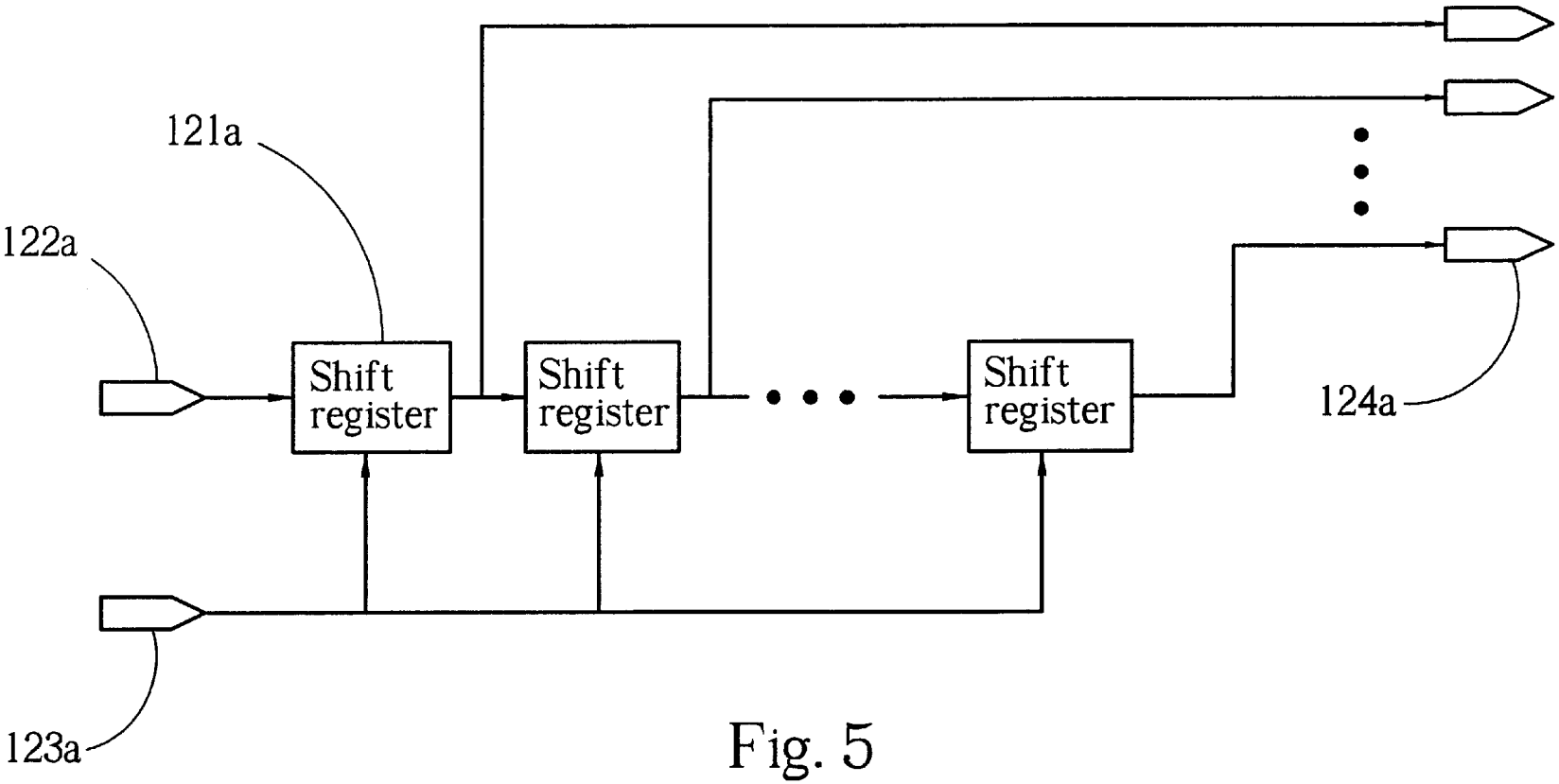
FIG. 5 shows the block diagram of an embodiment of sampling unit with the serial structure according to the present invention.

The structure of sampling unit 12 can be serial or parallel, and FIG. 5 is the block diagram of an embodiment of sampling unit 12 with a serial structure. The sampling unit 12, shown in FIG. 5, includes a plurality of shift registers 121*a* which are serially connected, a data input port 122*a* for transmitting pixel signals, a clock input port 123*a* for transmitting sampling clocks, and a plurality of data output ports 124*a* linked to the outputs of shift registers 121*a*. Each shift register 121*a* has a data input, a clock input, and an output, and the numbers of shift registers 121*a*, data output ports 124*a*, and sampling instants 171 of a sampling packet are equal. Also, data input, clock input, and output of first shift register 121*a* are respectively connected to data input port 122*a*, clock input port 123*a*, and first data output port 124*a*. Similarly, data inputs, clock inputs, and outputs of others shift registers 121*a* are connected to the outputs of their previous shift registers 121*a*, clock input port 123*a*, and other related data output ports 124*a*, respectively. Besides, at each sampling instant 171 of a sampling packet transmitted by clock input port 123*a*, the first shift register 121*a* samples the pixel signal sequence 16 transmitted by data input port 122*a*, and latches the sampled signal in its output. Similarly, at each sampling instant 171 of a sampling packet, the other shift registers 121*a* sample the signals in their inputs, and latch the sampled signals in their outputs. Consequently, the sampled pixel signals corresponding to sampling instants 171 of a sampling packet are holed in data output ports 124*a*.

Figure 6:
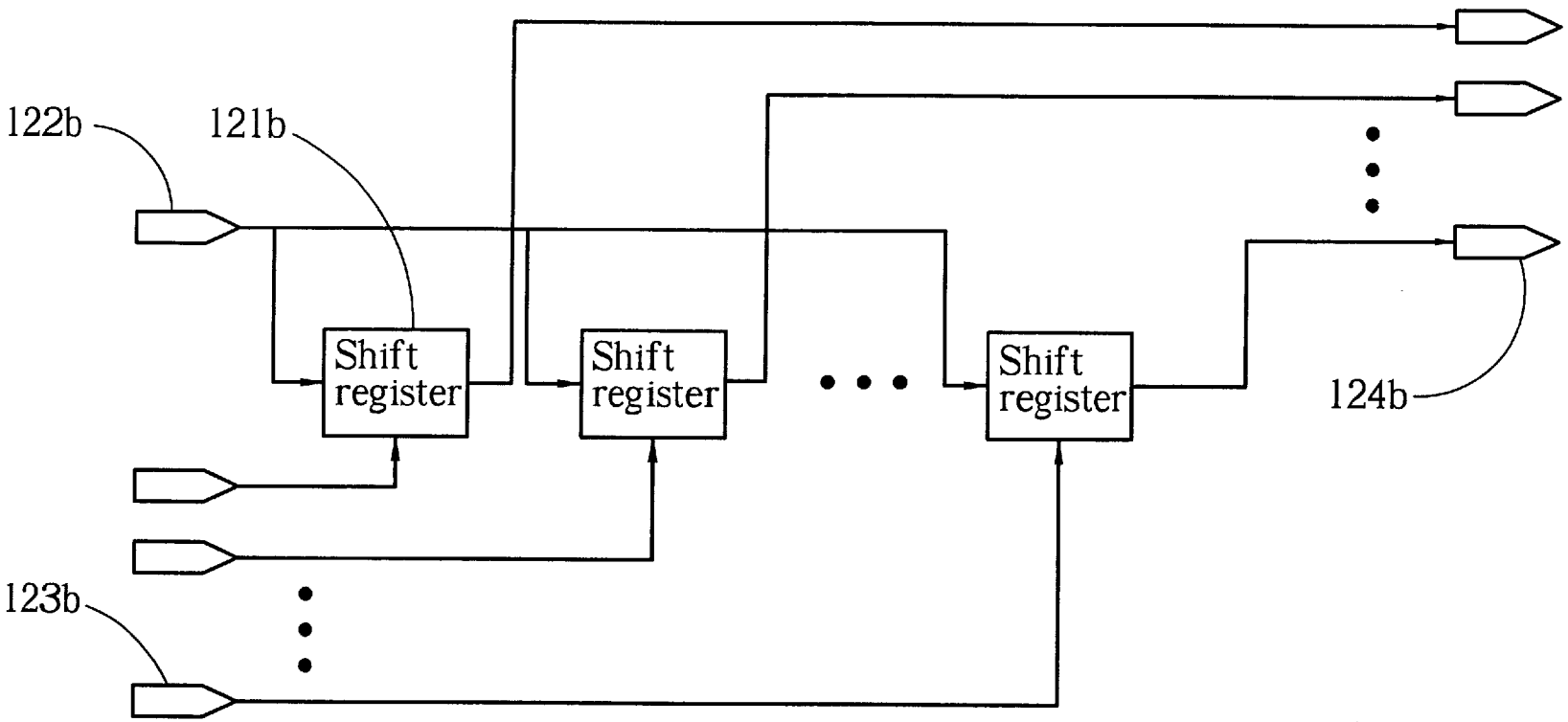
FIG. 6 shows the block diagram of an embodiment of sampling unit with the parallel structure according to the present invention.

Please refer to FIG. 6, which shows the block diagram of an embodiment of sampling unit 12 with parallel structure according to present invention. The sampling unit 12, shown in FIG. 6, includes a plurality of shift registers 121*b*, a data input port 122*b* for transmitting pixel signals, a plurality of clock input ports 123*b* for transmitting sampling clocks, and a plurality of data output ports 124*b* linked to the outputs of shift registers 121*b*. Each shift register 121*b* has a data input, a clock input and an output, and the numbers of shift registers 121*b*, data output ports 124*b*, clock input ports 123*b* and sampling instants 171 of a sampling packet are equal. Also, data input, clock input, and output of shift registers 121*b* are respectively connected to data input port 122*b*, related clock input ports 123*b*, and related data output ports 124*b*. At each sampling instant 171 of a sampling packet transmitted by related clock input port 123*b*, a related shift register 121*b* samples the pixel signal sequence 16 transmitted by data input port 122*b*, and latches the sampled signal in its output. Consequently, the sampled pixel signals corresponding to sampling instants 171 of a sampling packet are holed in data output ports 124*b*.

The accumulation unit 14 includes a filter 141 and a data processor 142. The filter 141 is used to exclude the difference whose value is smaller or bigger than some limited values. The data processor 142 can be a counter used to count the number of sampling packets at which the filtered difference of sampled pixel signals is not zero. The data processor 142 can be an accumulator used to accumulate the filtered differences of sampled pixel signals. The data processor 142 can be a calculator with counting and accumulating functions.

Figure 1:
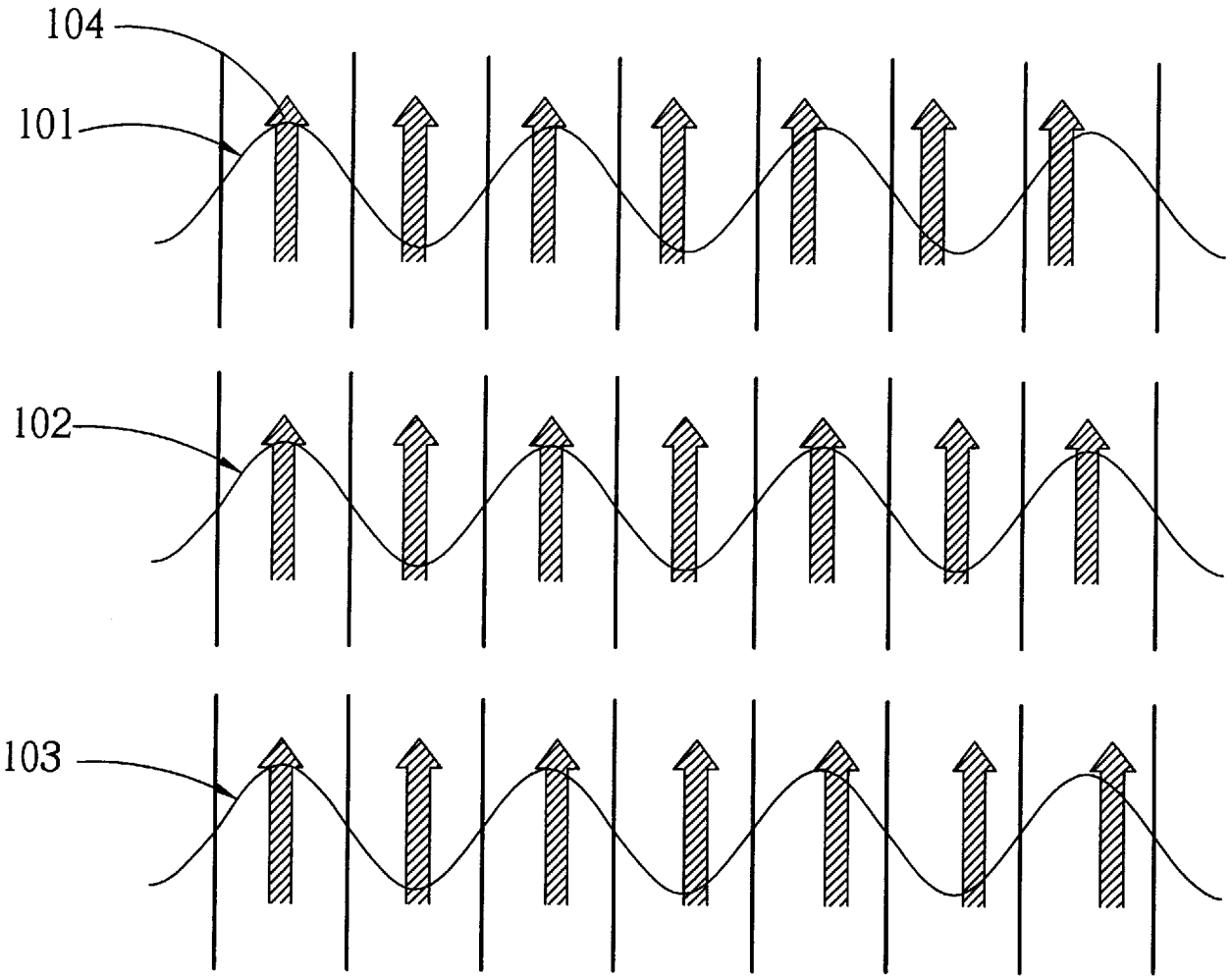
FIG. 1 is the diagram illustrating the unmatched frequency relation between three pixel clocks of display interface card of a PC display and the displaying clock of a digital display.
Figure 2:
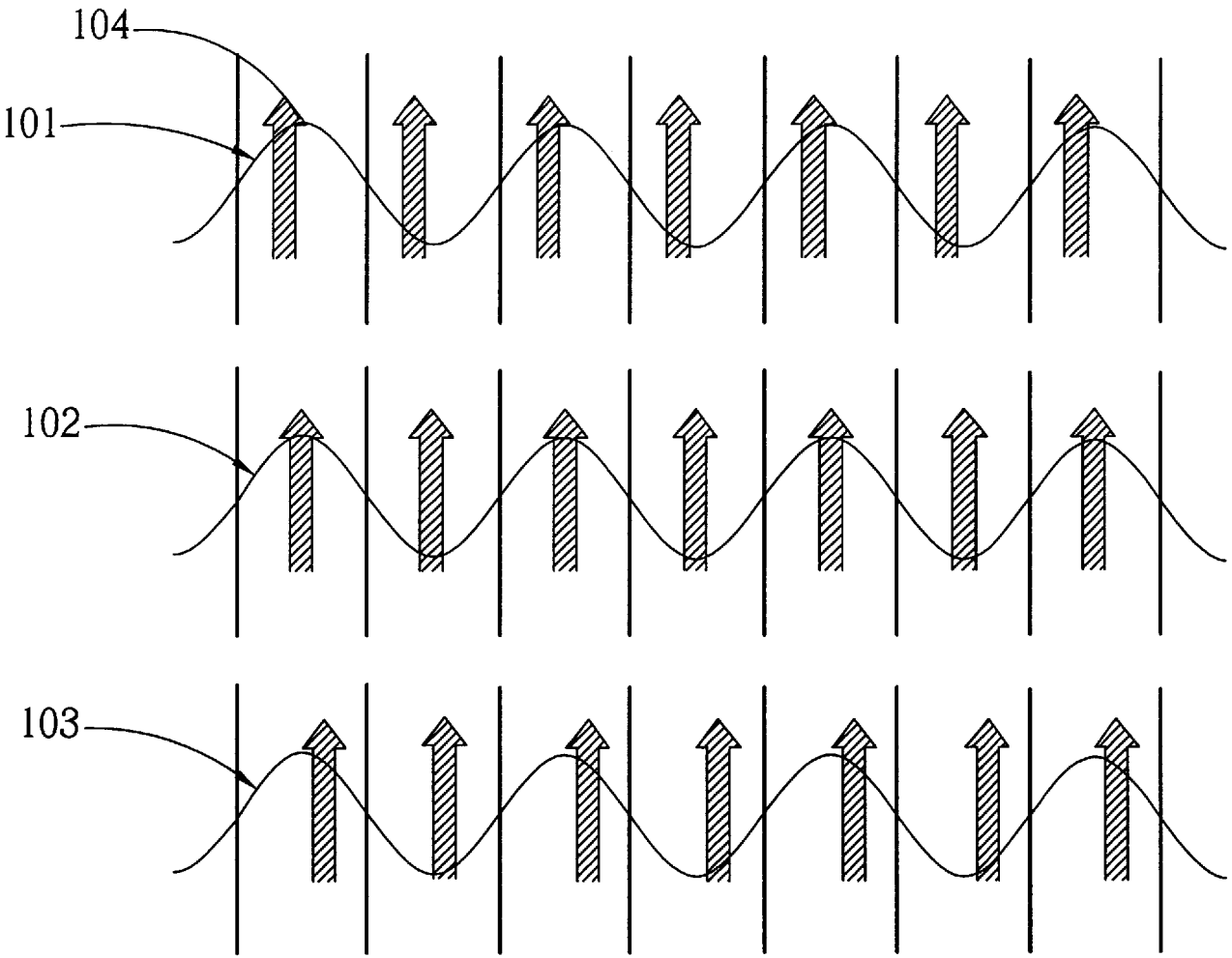
FIG. 2 is the diagram illustrating the unmatched phase relation between three pixel clocks of display interface card of a PC display and the displaying clock of a digital display.
Figures 1, 9:
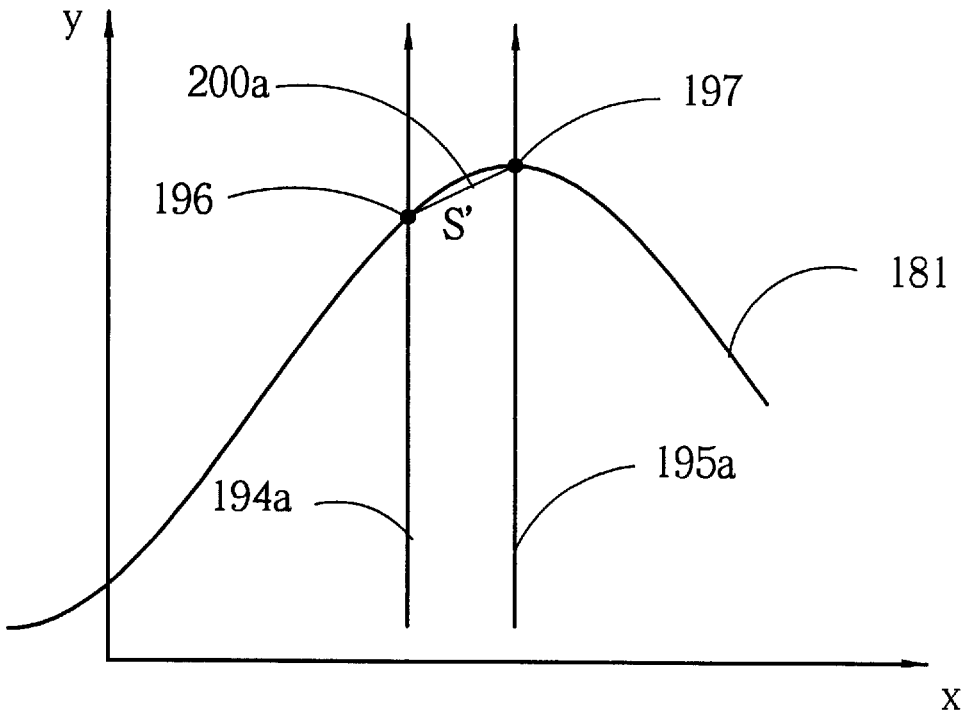
Figures 2, 9:
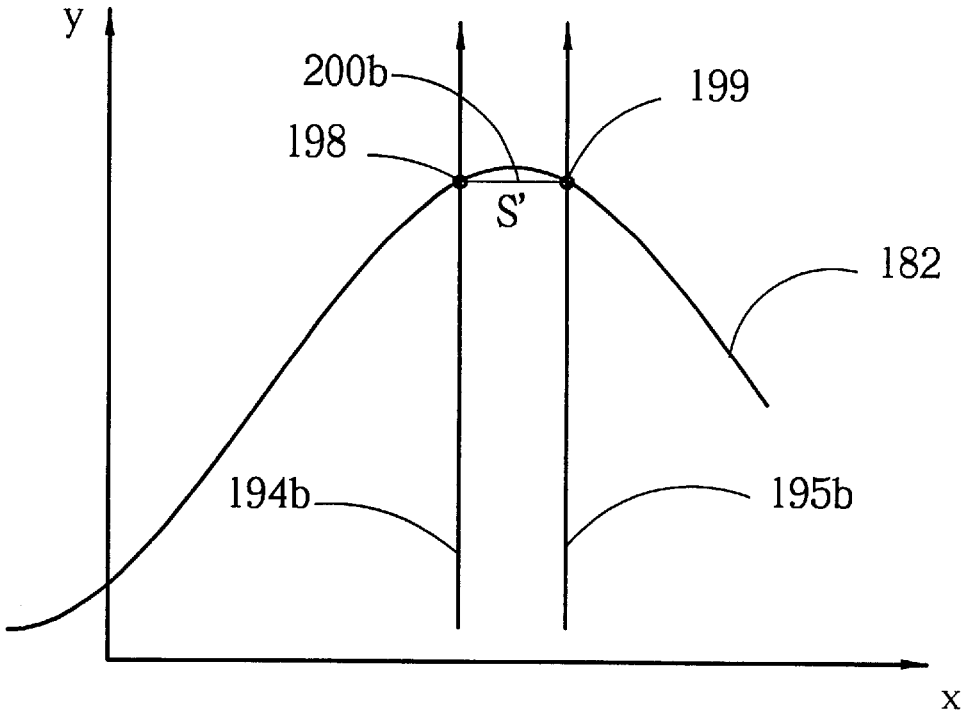

In order to exactly measure the frequency and phase of pixel clock of the interface card, more than one sampling instants of sampling packet of sampling clock are used to sample the pixel signals of display interface card. Taking the example of FIG. 7 and FIG. 8, which show an embodiment of invention, the decision method adopted is through the variation slope of section lines formed between the sampling points. Please refer to FIG. 7, which shows a sampling packet sequence of present invention for phase detection while each sampling packet possesses two sampling instants. Also in FIG. 7, there are three pixel signal sequences 181, 182 and 183, and each pixel signal sequence consists of a plurality of pixel signals based on a pixel clock. Besides, there are three sampling clocks 191, 192 and 193 with different phases and a same frequency as the pixel clock. Each sampling clock consists of a plurality of sampling packets where each sampling packet includes two sampling instants. In addition, every sampling packet of sampling clock 191 consists of sampling instants 194*a* and 195*a*. Every sampling packet of sampling clock 192 consists of sampling instants 194*b* and 195*b*. Every sampling packet of sampling clock 193 consists of sampling instants 194*c* and 195*c*. At the same time, based on these sampling instants, the pixel signals of display interface card are sampled. The variation slope S of a sampling clock is formulated as follows:

$$S = \sum_{i=0}^{n} \lim_{\Delta x_i \to 0} \frac{\Delta y_i}{\Delta x_i} \tag{1}$$

where $\Delta y_i$ denotes the difference value of both sampled signals at the sampling instants of a sampling packet, and $\Delta x_i$ denotes the time difference between both sampling instants of a sampling packet. As shown in FIG. 9-1, at sampling instants 194*a* and 195*a*, the pixel signal sequence 181 is sampled at two points 196 and 197 with the variation slope S' denoted by section line 200*a*. Since the variation slope S' is clearly larger than zero, it is noted that the phase of sampling clock 191 is leading before the pixel clock of pixel signal sequence 181. As shown in FIG. 9-2, at sampling instants 194*b* and 195*b*, the pixel signal sequence 182 is sampled at two points 198 and 199 with the variation slope S' denoted by section line 200*b*. Since the variation slope S' is almost zero, it is noted that the phases of sampling clock 192 and the pixel clock of pixel signal sequence 182 are matched. Similarly, the phase of sampling clock 193 is lagging after the pixel clock of pixel signal sequence 183.

Figure 7:
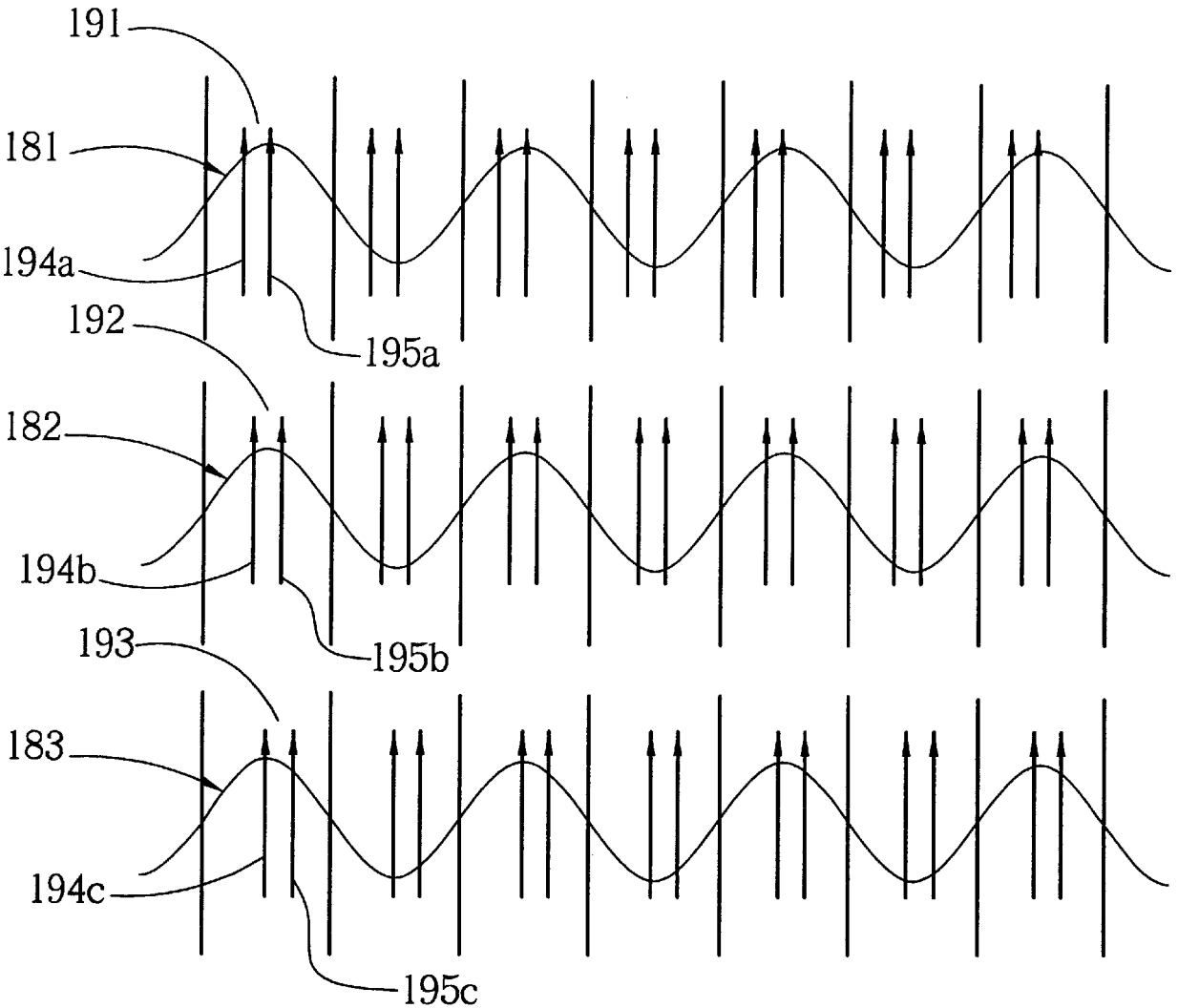
FIG. 7 shows a sampling packet sequence of present invention for phase detection, which each sampling packet possesses two sampling instants.
Figure 8:
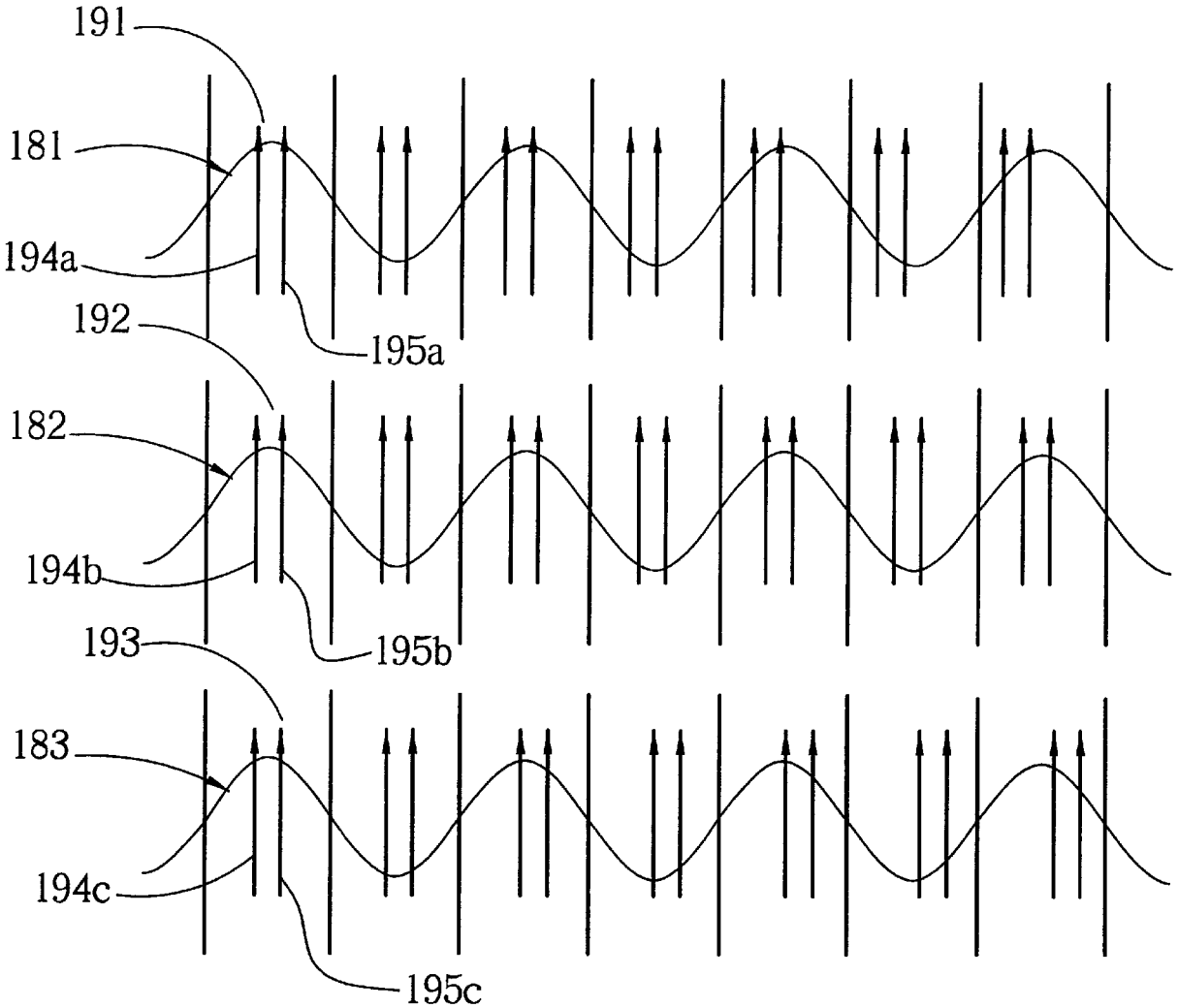
FIG. 8 shows a sampling packet sequence of present invention for frequency detection, which each sampling packet possesses two sampling instants.

Please refer to FIG. 8, which shows a sampling packet sequence of the present invention for frequency detection where each sampling packet possesses two sampling instants. Similar to the phase detection as shown in FIG. 7, the frequencies of sampling clocks 191, 192 and 193 are respectively faster than, almost equal to, and slower than the pixel clocks of pixel signal sequences 181, 182 and 183.

Figure 10:
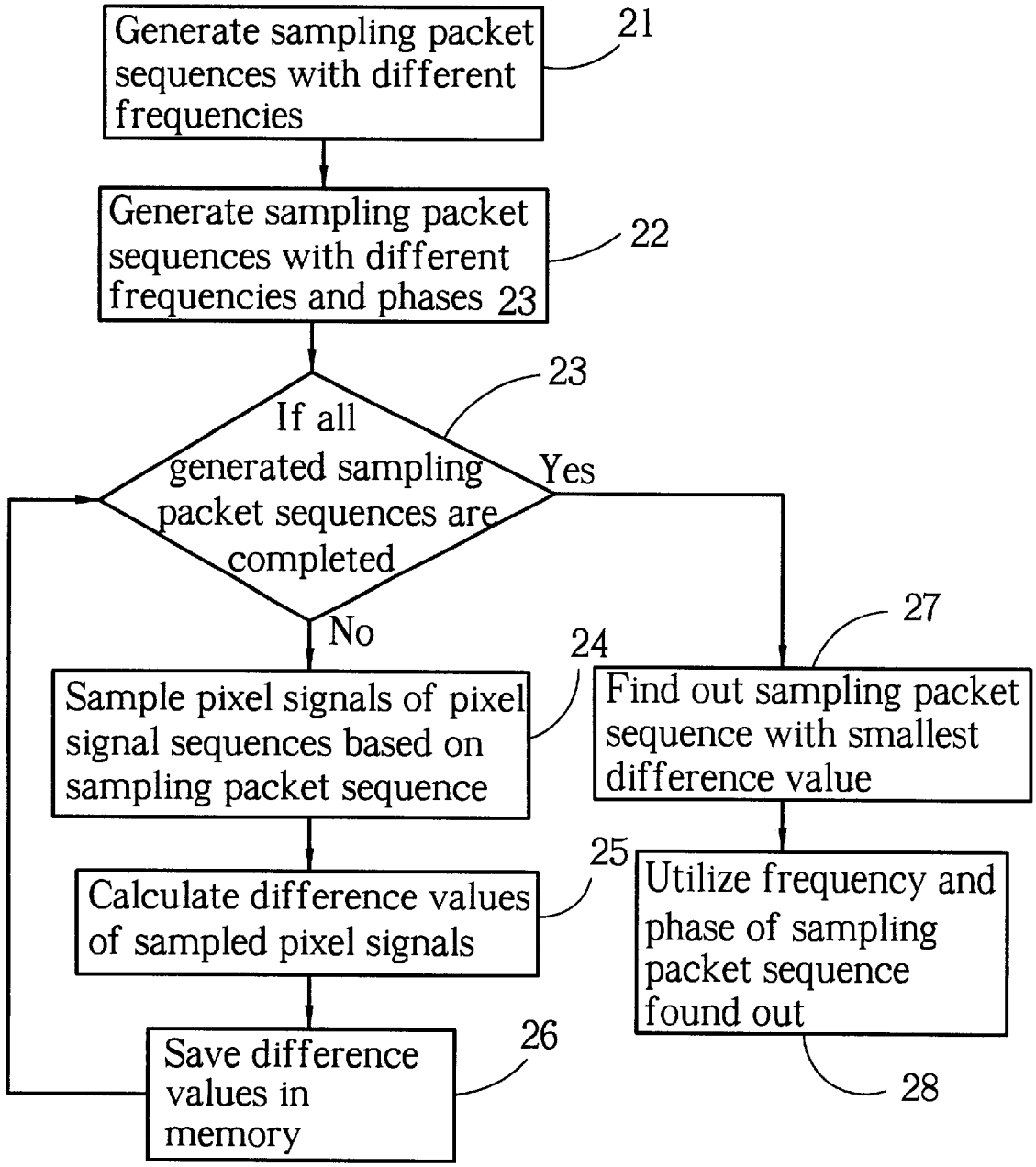
FIG. 10 is the flow chart of first embodiment of the automatic detection method according to the present invention for measuring the phase and frequency of a pixel clock.

Please refer to FIG. 10, which is the flow chart of first embodiment of the automatic detection method according to present invention for measuring the phase and frequency of a pixel clock. First, at the steps 21 and 22, the clock generation unit 11 generates a plurality of sampling packet sequences with different frequencies and phases. The sampling packet sequences with different frequencies are first generated, and let the phases of these sampling packet sequences be zeros. Based on a sampling packet sequence with a frequency and a zero phase, a plurality of sampling packet sequences with the same frequency and different phases are then produced. By the step 23, all generated sampling packet sequences must be sent to sampling unit 12 for sampling the pixel signals 161 of pixel signal sequence 16 (at step 24). All the sampled pixel signals at the sampling instants of a sampling packet are stored in shift registers 121*a* or 121*b*. At the step 25, based on all sampling sequences, the stored pixel signals are transmitted to data processing unit 13 for calculating the difference values of sampled pixel signals. All difference values of sampled pixel signals based on every sampling packet sequence are counted or accumulated by accumulation unit 14, and then these counted or accumulated values are saved in a memory at the step 26. When all sampling packet sequences have been used for sampling pixel signals have been processed, the decision unit 15 finds out the sampling packet sequence with the smallest counted or accumulated value at the step 27, and then let the frequency and phase of found sampling packet sequence be those of displaying clock of display (at step 28).

Figure 11:
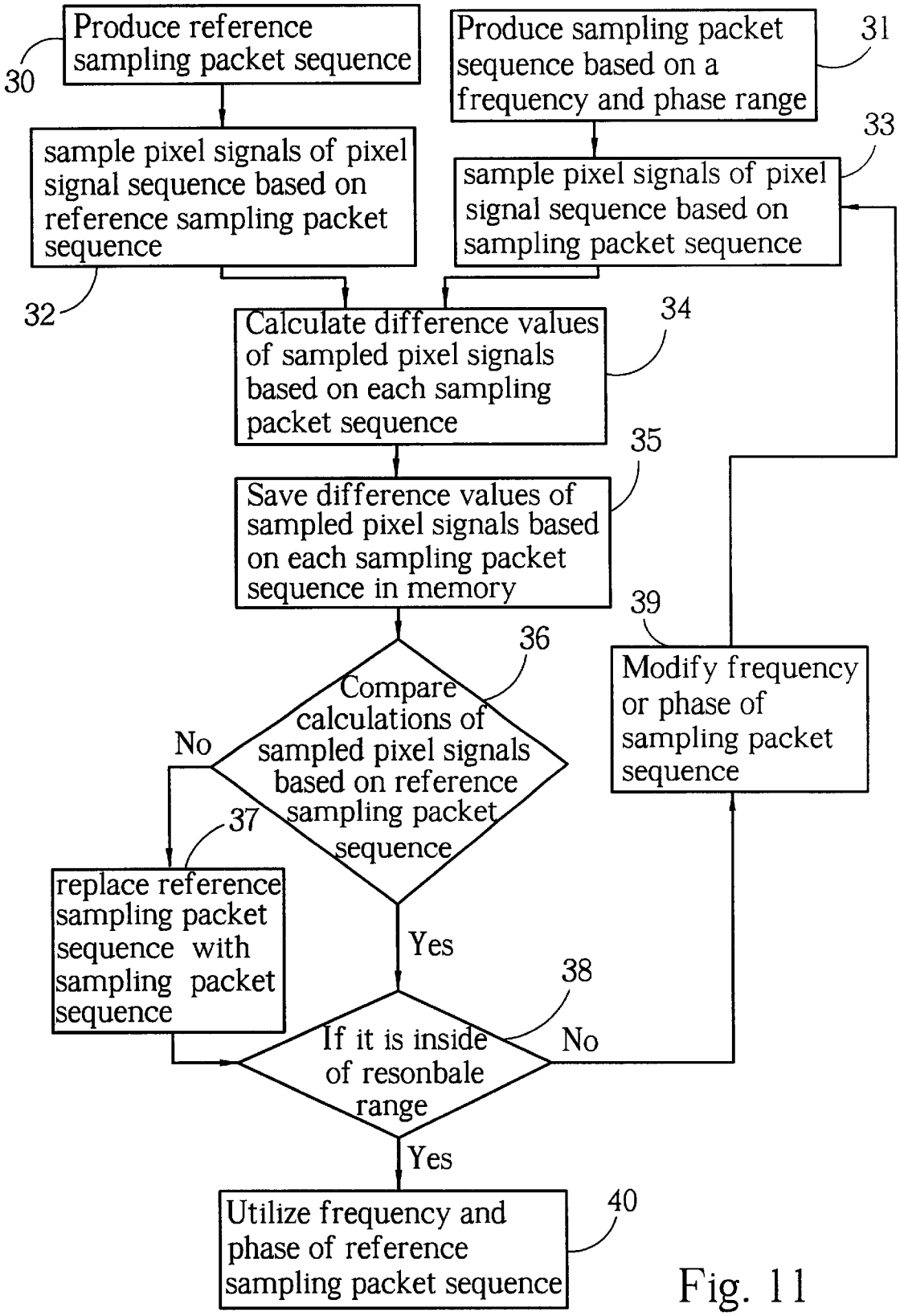
FIG. 11 is the flow chart of second embodiment of the automatic detection method according to the present invention for measuring the phase and frequency of a pixel clock.

Please refer to FIG. 11, which is the flow chart of second embodiment of the automatic detection method according to present invention for measuring the phase and frequency of a pixel clock. At the steps 30 and 31, the clock generation unit 11 produces a reference sampling packet sequence and a sampling packet sequence, respectively. The phase and frequency of reference sampling packet sequence is equal to as the present phase and frequency $f_0$ of display. The reference sampling packet sequence is chosen from a group sampling packet sequences whose phases and frequencies are respectively selected from the following sets:

Phase:

$$\left\{\frac{360^\circ \cdot k}{16}\middle| k \text{ is one of the integers from 0 to 15.}\right\}$$

Frequency: $\{f_0 \pm k \cdot \Delta f | \Delta f$ is a positive number, k is one of the integers from 0 to 10.$\}$ Then, both sequences are respectively transmitted to sampling unit 12 for sampling the pixel signals 161 of pixel signal sequence 16 at the steps 32 and 33. After that, all the sampled pixel signals at sampling instants of a sampling packet are then stored in shift registers 121*a* or 121*b*. At the step 34, based on both sampling sequences, the stored pixel signals are transmitted to data processing unit 13 for computing the difference values of sampled pixel signals. All difference values of sampled pixel signals based on each sampling packet sequence are counted or accumulated by accumulation unit 14, and then these counted or accumulated values are saved in a memory at the step 35. At the step 36, the decision unit 15 compares the counted or calculated results of sampled pixel signals based on both sampling sequences. If the result based on the reference sampling packet sequence is a smaller one, the decision unit 15 will check whether it locates inside a reasonable range (at the step 38). If the answer of the step 38 is YES, the decision unit 15 will let the frequency and phase of reference sampling packet sequence be those of the displaying clock of display (at step 40). Otherwise, at the step 39, the decision unit 15 will modify the frequency or phase of sampling packet sequence and the procedure will go back to step 33. At the step 36, if the result based on sampling packet sequence is not a bigger one, the decision unit 15 will replace the reference sampling packet sequence with sampling packet sequence (at the step 37) and the procedure will go into the step 38. Then, the operation steps in FIG. 11 will keep running until the step 40 is done.

Figure 12:
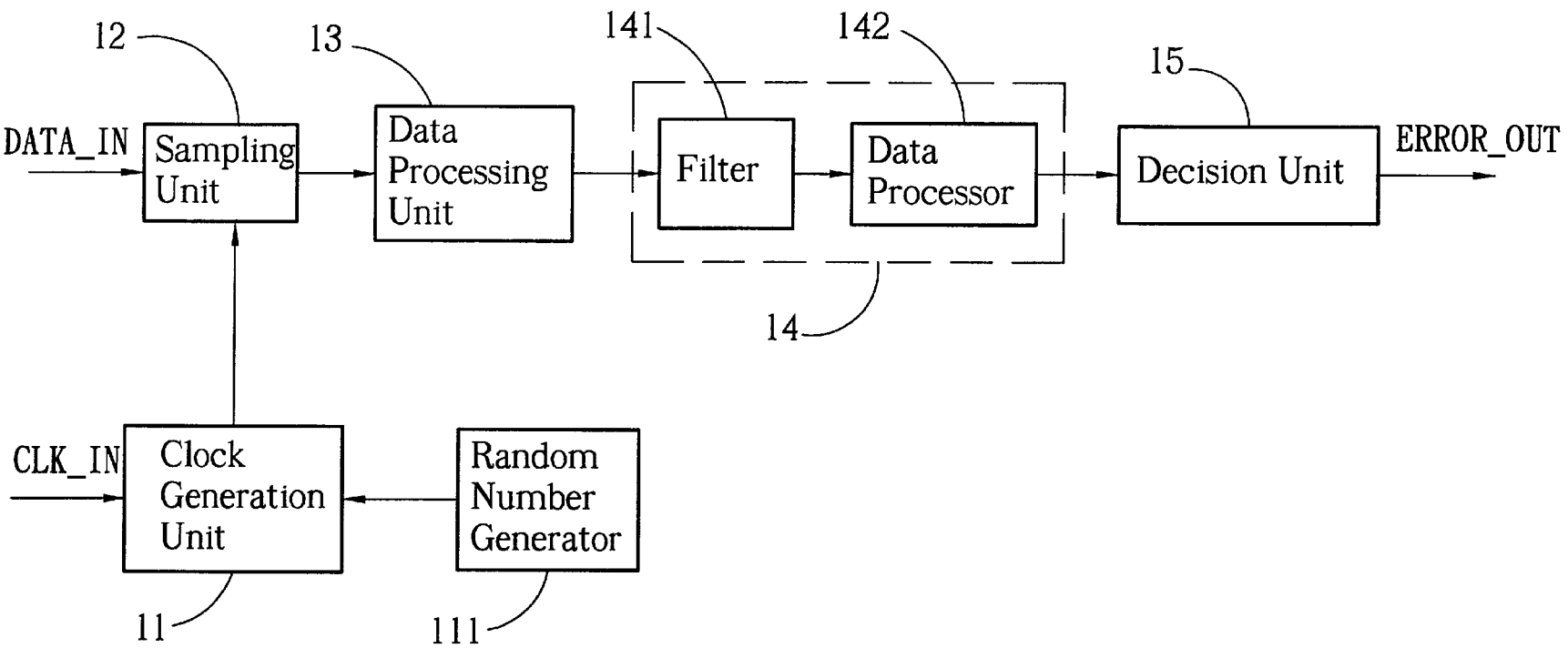
FIG. 12 shows the block diagram of second embodiment of the automatic detection apparatus according to present invention.

Please refer to FIG. 12, which shows the block diagram of second embodiment of the automatic detection apparatus according to present invention. This automatic detection apparatus further includes a random number generator 111 in clock generation unit 11. The random number generator 111 can be a 3-bit reversion counter with eight counting duration. For example, if the initial value of 3-bit reversion counter is zero, the value of counter will go back to zero after eight counts. The random number generator 111 can randomly produce a number to clock generation unit 11 for generating a sampling packet sequence. As shown in FIG. 13, the random number generator 111 randomly generates a number in the range from zero to seven, and then it cyclically counts from zero based on a clock. No matter when the randomly produced number appears, the clock generation unit 11 creates a sampling packet for sampling. For example, the mark "O" denotes that the clock generation unit 11 generates a sampling packet, and the mark "X" denotes that the clock generation unit 11 does not generates any sampling packet. It is noted that the mark "O" repeatedly occurs after seven "X" marks appears in this embodiment. Hence, the sampling rate of any sampling packet sequence generated by clock generation unit 11 is the eighth of clock's rate of 3-bit reversion counter. In addition, all generated sampling packet sequences of embodiment cannot be correlated in order to measure the frequency and phase of the pixel clock exactly.

It is noted that the automatic detection method for tuning the frequency and phase of a display and the automatic detection apparatus using this method described above are the preferred embodiments of present invention for the purposes of illustration only, and are not intended as a definition of the limits and scope of the invention disclosed. Any modifications and variations that may be apparent to a person skilled in the art are intended to be included within the scope of present invention.

What is claimed is:

1. An automatic detection method for tuning the frequency and phase of a display, comprising the following steps:

A. generating a plurality of sampling packet sequences with different frequencies and phases from each other, and with a plurality of sampling instants in every sampling packet;

B. sampling a pixel signal sequence at each sampling instant of generated sampling packet sequences;

C. calculating the difference value of adjacent sampled pixel signals in every sampling packet of generated sampling packet sequences;

D. accumulating the calculated difference values of every sampling packet sequence, and storing the accumulated values of all generated sampling packet sequences in a memory; and E. using the frequency and phase of generated sampling packet sequence with the smallest accumulated value as those of displaying clock of said display.

2. The automatic detection method for tuning the frequency and phase of a display as claimed in claim 1 wherein said sampling packet sequences are generated by a clock generation unit.

3. The automatic detection method for tuning the frequency and phase of a display as claimed in claim 1 wherein said difference values are calculated by a data processing unit.

4. The automatic detection method for tuning the frequency and phase of a display as claimed in claim 1 wherein said accumulated values are summed by an accumulation unit.

5. An automatic detection method for tuning the frequency and phase of a display, comprising the following steps:

A. generating a reference sampling packet sequence with a plurality of sampling instants in every sampling packet;

B. generating a sampling packet sequence with a plurality of sampling instants in every sampling packet;

C. sampling a pixel signal sequence at each sampling instant of said reference sampling packet sequence;

D. sampling said pixel signal sequence at each sampling instant of said sampling packet sequence;

E. calculating the difference value of adjacent sampled pixel signals in every sampling packet of said reference sampling packet sequence and said sampling packet sequence, respectively;

F. accumulating the calculated difference values of said reference sampling packet sequence and said sampling packet sequence, respectively;

G. comparing the accumulated values of said reference sampling packet sequence and said sampling packet sequence; when the accumulated value of said reference sampling packet sequence is a smaller one, going to the following step I; otherwise, going to the following step H;

H. replacing said reference sampling packet sequence with said sampling packet sequence;

I. checking whether the accumulated value of said reference sampling packet sequence is located in a range; if YES, going to the following step K, otherwise, going to the following step J;

J. modifying the frequency or phase of said sampling packet sequence, and going back to the step D; and K. using the frequency and phase of said reference sampling packet sequence as those of displaying clock of said display.

6. The automatic detection method for tuning the frequency and phase of a display as claimed in claim 5 wherein said reference sampling packet sequence is generated by a clock generation unit.

7. The automatic detection method for tuning the frequency and phase of a display as claimed in claim 5 wherein said sampling packet sequence is generated by a clock generation unit.

8. The automatic detection method for tuning the frequency and phase of a display as claimed in claim 5 wherein said difference values are calculated by a data processing unit.

9. The automatic detection method for tuning the frequency and phase of a display as claimed in claim 5 wherein said accumulated values are summed by an accumulation unit.

10. The automatic detection method for tuning the frequency and phase of a display as claimed in claim 5 wherein said sampling packet sequence is amended by increasing or decreasing its frequency.

11. The automatic detection method for tuning the frequency and phase of a display as claimed in claim 5 wherein said sampling packet sequence is amended by increasing or decreasing its phase.

12. The automatic detection method for tuning the frequency and phase of a display as claimed in claim 5 wherein said range is between a negative constant and a positive constant.

13. An automatic detection apparatus for tuning the frequency and phase of a display, comprising:

a clock generation unit used for producing a plurality of sampling packet sequences;

a sampling unit used for sampling a plurality of pixel signals based on said pixel signal sequences;

a data processing unit used for calculating the difference values of all adjacent sampled pixel signals based on said sampling packet sequences;

an accumulation unit used for processing said difference values and storing the processed values; and a decision unit used for finding the frequency and phase of displaying clock of said display matching the frequency and phase of a pixel clock according to the processed values.

14. The automatic detection apparatus for tuning the frequency and phase of a display as claimed in claim 13 wherein said clock generation unit comprises a random number generator used to let said clock generation unit randomly produce a plurality of sampling packet sequences.

15. The automatic detection apparatus for tuning the frequency and phase of a display as claimed in claim 13 wherein said sampling unit has a serial structure.

16. The automatic detection apparatus for tuning the frequency and phase of a display as claimed in claim 13 wherein said sampling unit has a parallel structure.

17. The automatic detection apparatus for tuning the frequency and phase of a display as claimed in claim 13 wherein said accumulation unit comprises:

a filter for excluding said difference values which are smaller or bigger than certain limited values; and a data processor for processing the filtered difference values.

18. The automatic detection apparatus for tuning the frequency and phase of a display as claimed in claim 17 wherein said data processor is a counter for counting the number of sampling packets at which the filtered difference values of sampled pixel signals are not zero.

19. The automatic detection apparatus for tuning the frequency and phase of a display as claimed in claim 17 wherein said data processor is an accumulator for accumulating the filtered difference values.

* * * * *